United States Patent [19]

Kent et al.

[11] 4,224,146

[45] Sep. 23, 1980

[54] SIFTING MACHINES

[75] Inventors: Anthony J. Kent, Newark; William Woodburn, Aberdeen, both of Great Britain

[73] Assignee: United Wire Group Limited, Edinburgh, Great Britain

[21] Appl. No.: 941,803

[22] Filed: Sep. 11, 1978

[30] Foreign Application Priority Data

Sep. 13, 1977 [GB] United Kingdom ..... 38083/77
Sep. 13, 1977 [GB] United Kingdom ..... 38084/77

[51] Int. Cl.[2] ..... B07B 1/46

[52] U.S. Cl. ..... 209/243; 209/325; 209/405; 210/388

[58] Field of Search ..... 209/405, 408–409, 209/412–413, 309, 325–327, 331–333, 341, 346, 403–404, 311, 313, 243, 248, 254; 210/388, 389, 232, 405

[56] References Cited

U.S. PATENT DOCUMENTS

| | | | |
|---|---|---|---|
| 543,088 | 7/1895 | Gray | 209/254 |
| 1,270,896 | 7/1918 | Stuart | 209/248 X |
| 2,020,131 | 11/1935 | Behuke | 209/313 |
| 2,088,313 | 7/1937 | Wettlaufer | 209/326 |
| 2,682,338 | 6/1954 | Hurst | 210/389 X |
| 2,716,493 | 8/1955 | Hutchison | 210/389 |
| 2,750,043 | 6/1956 | Thompson | 210/389 X |
| 2,899,061 | 8/1959 | Schroth | 209/408 |
| 2,959,285 | 11/1960 | Tongos | 209/405 X |
| 3,570,670 | 3/1971 | Endo | 210/388 X |
| 4,040,951 | 8/1977 | Cole | 209/408 |

*Primary Examiner*—Robert Halper
*Attorney, Agent, or Firm*—Mason, Fenwick & Lawrence

[57] ABSTRACT

In a sifting machine having a driven vibratory screen assembly comprising a so-called sifting basket of which a screen forms the base, the screen is releasably located by a plurality of spaced bars which extend across the screen and project at their ends through side walls of the basket. The projecting end portions of the bars are bolted to external supports on the side walls, and the bars carry spring-loaded plungers which press the frame of the screen against internal ledges on the side walls.

5 Claims, 8 Drawing Figures

SIFTING MACHINES

This invention relates to a sifting machine having a driven vibratory screen assembly comprising a sifting basket, and a sifting screen within the basket.

An object of the present invention is to provide in a machine of the kind aforesaid means whereby the screen, which is attached to a frame prior to fitment to the basket, may be attached to and removed from the basket more easily and quickly than hitherto, especially when the screen is clamped midway between its sides, or consists of two or more side-by-side sections, or access to the top of the screen is obscured by other equipment, such for example as a chute and cyclone separators.

According to the present invention there is provided in a sifting machine of the kind aforesaid, means for releasably locating the screen in the basket, said means comprising at least one bar extending across the screen and projecting at its ends through side walls of the basket, means clamping said ends to external supports on said side walls, and resilient means on said bar pressing the frame of the screen against internal supports on the basket.

Figure 1:
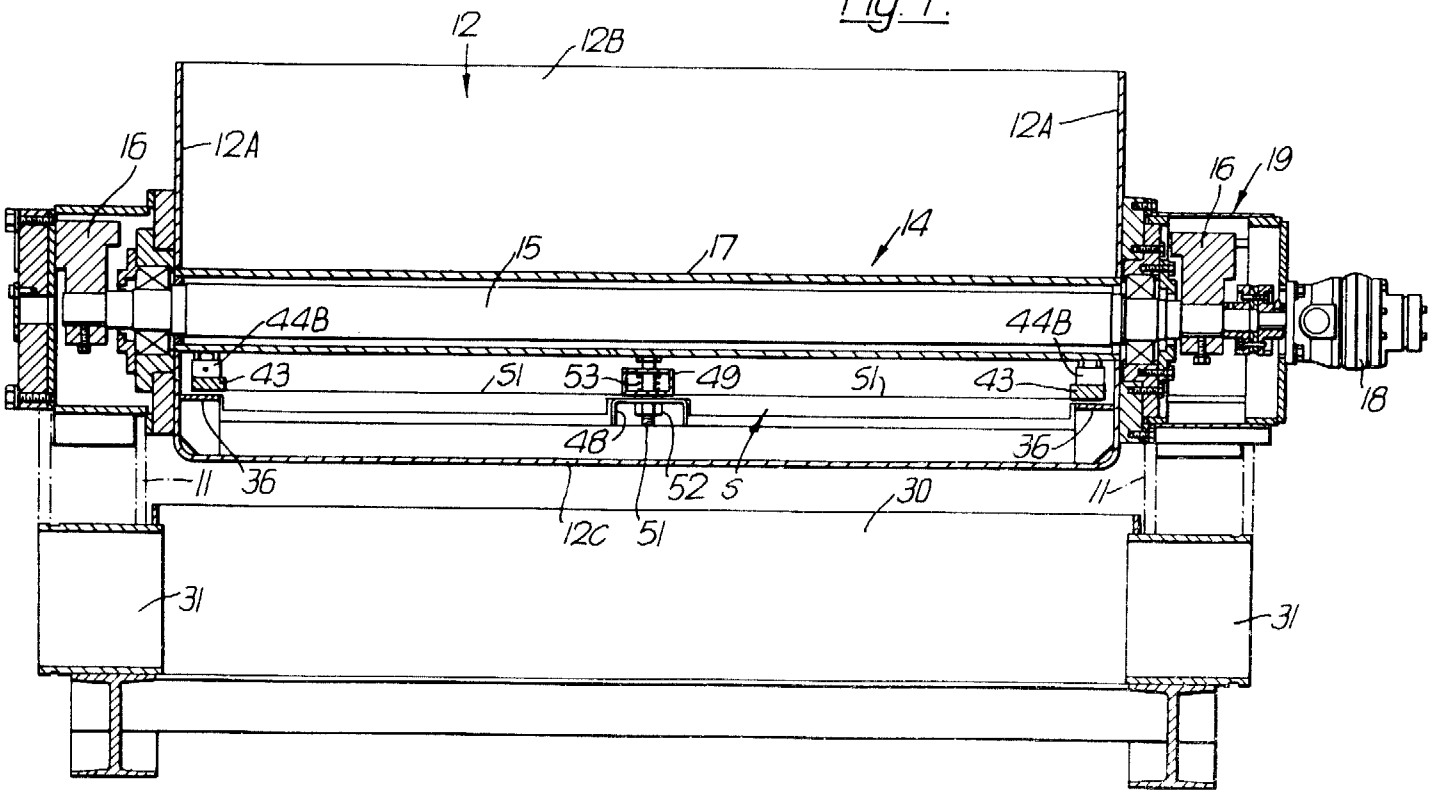
Figure 2:
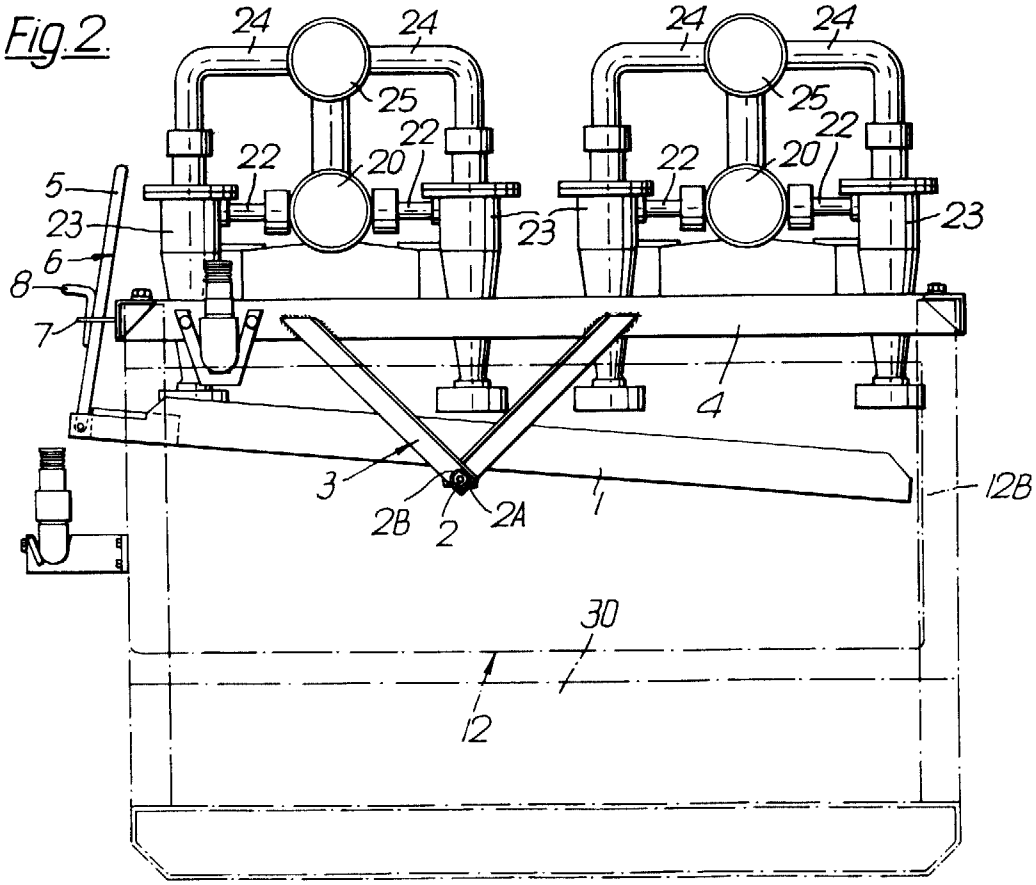
Figure 3:
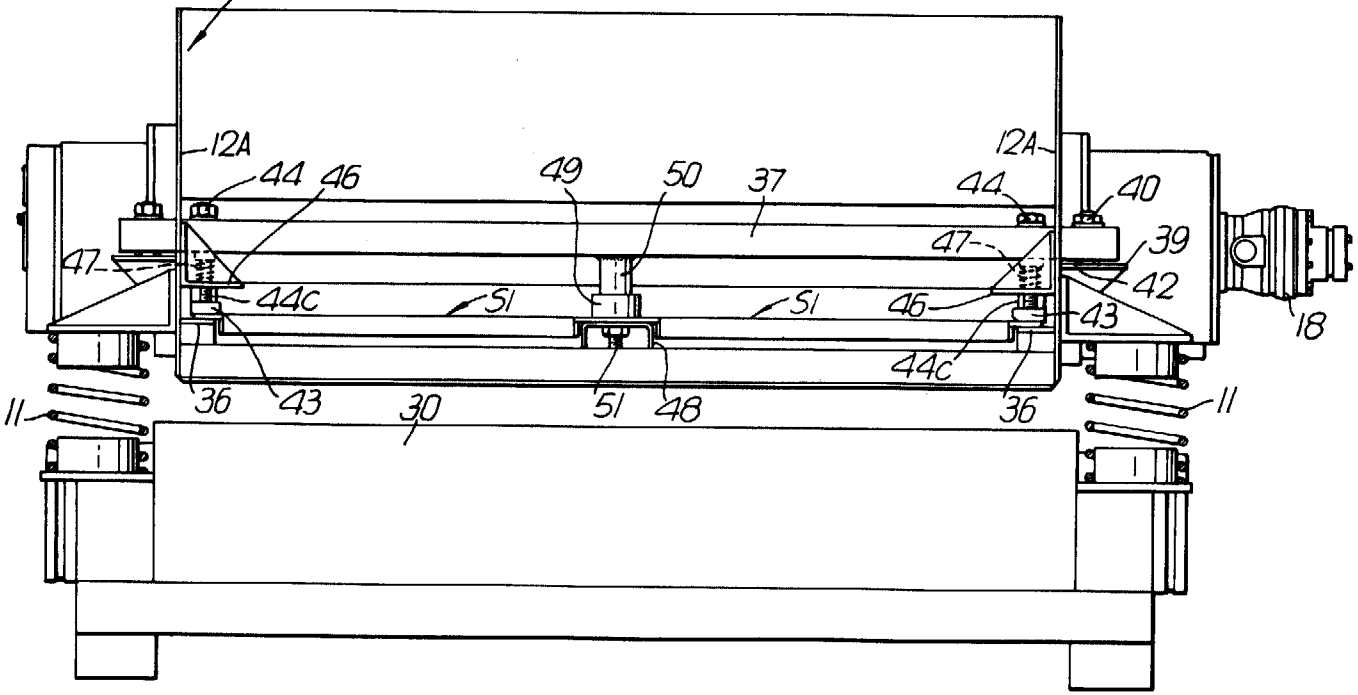
Figure 4:
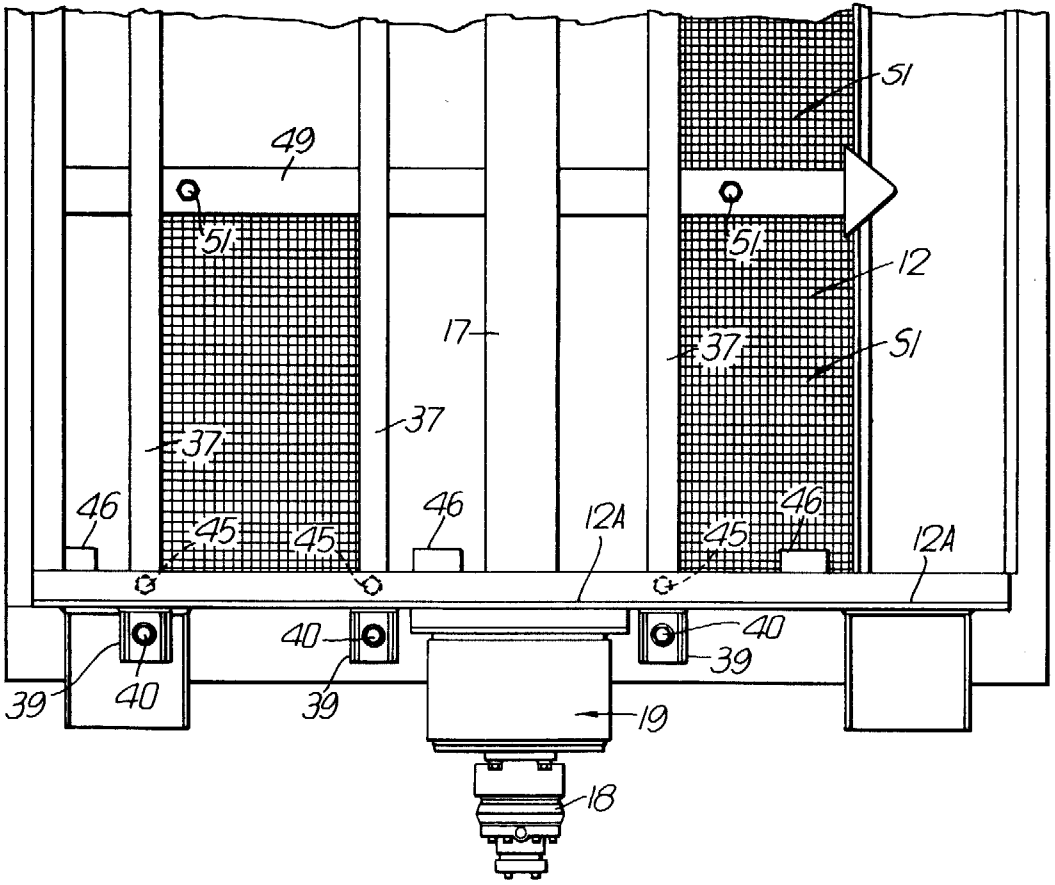
Figure 5:
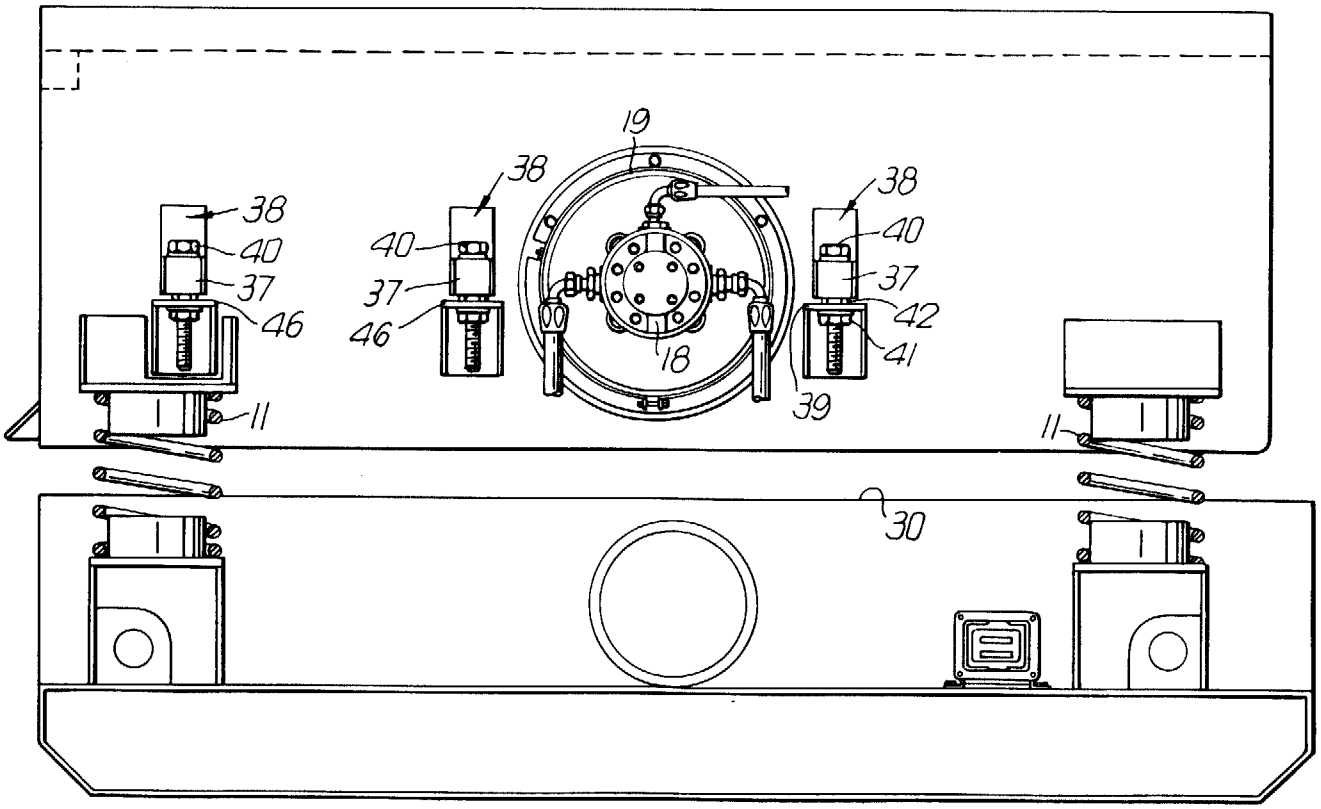
Figure 6:
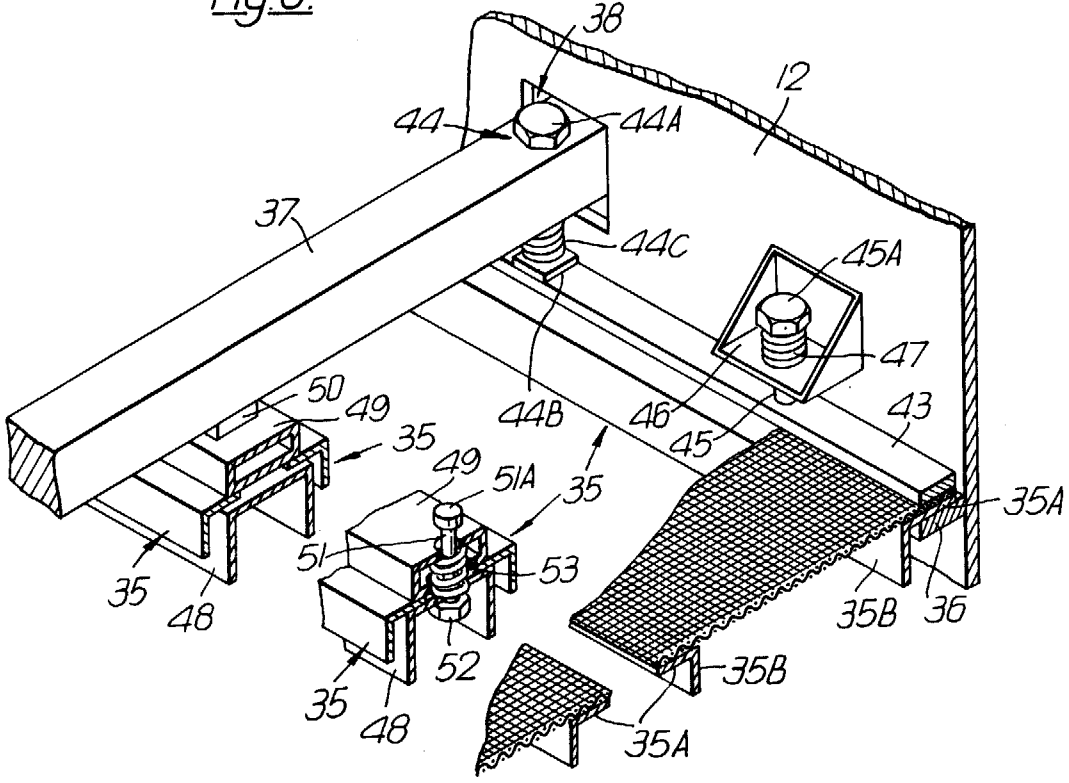
Figure 7:
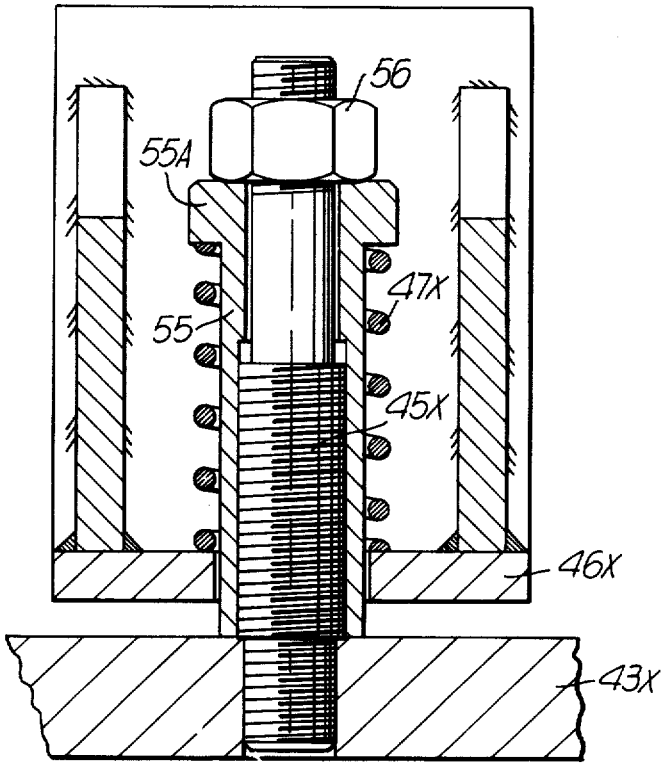
Figure 8:
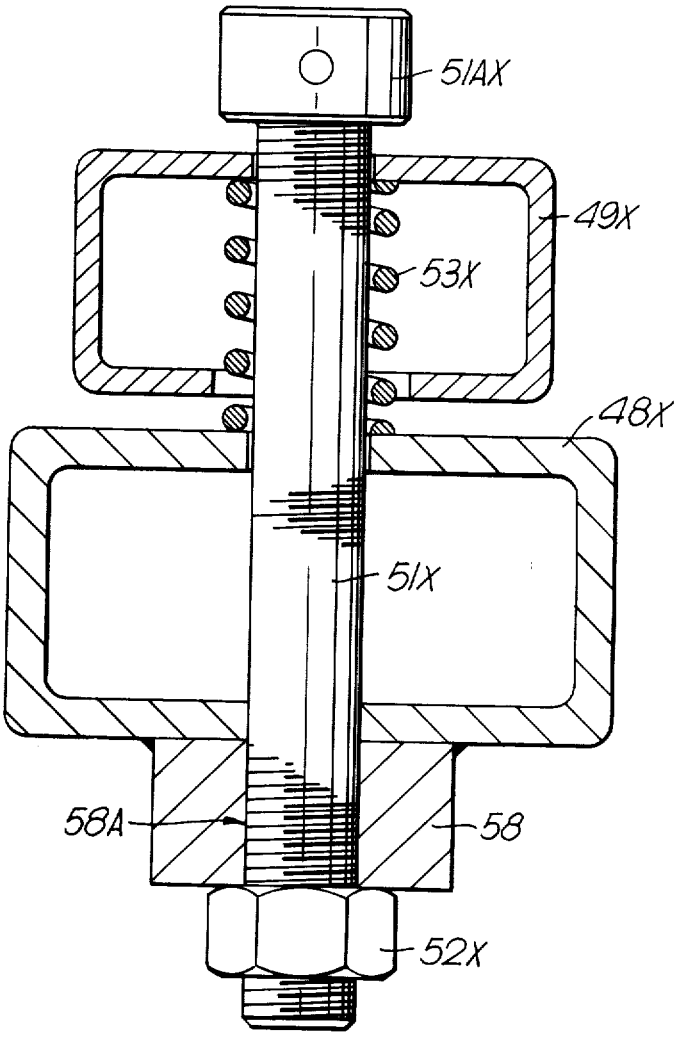

An embodiment of the invention will now be described, by way of example with reference to the accompanying drawings, in which:

FIG. 1 is a cross sectional view substantially midway between the ends of a sifting machine according to the present invention, FIG. 2 is a partly schematic side view corresponding to FIG. 1, to a smaller scale and showing a chute and a cyclone separator assembly, not shown in FIG. 1, FIG. 3 is an end view corresponding to FIG. 1, FIG. 4 is a plan view corresponding to FIG. 1, FIG. 5 is a side view corresponding to FIG. 1, FIG. 6 is a fragmentary, part-sectional end perspective view, FIG. 7 is a part-sectional detail view of a modification, and, FIG. 8 is a cross sectional detail view of a further modification, to a larger scale.

Referring to FIGS. 1 and 2 of the drawings, an inclined tray or chute 1 is pivotally mounted on a transverse shaft 2 located intermediate its ends, the shaft 2 being supported at opposite ends by opposed brackets 3 depending from the superstructure or framework 4 of the machine. The shaft 2 is secured to the brackets 3, by nuts 2A which are screwed on to end portions of the shaft which project through holes in the respective brackets 3. A washer 2B is provided between each of the nuts and the brackets.

The tray 1 can thus be pivoted between the position shown in FIG. 2, in which material fed to the tray discharges at the right hand side (in the drawing) on to one end of a screen S, FIG. 1, which extends below the tray, and a position in which the tray 1 is inclined in the opposite direction, and material discharges at the left hand side and clear of the screen.

In a modification, not shown, the end portions of the shaft 2 engage in open-topped, upstanding slots in lugs carried by the brackets 3.

Means is provided for manually adjusting and releasably locking the tray 1 in at least each of said positions, and one example of such means will now be described.

An upstanding lever 5 is pivotally attached at its lower end to the left hand end of the tray 1, and passes upwards through a ring or annular lug 7 secured to the superstructure 4. One face of the lever 5 has a plurality of spaced notches or gates 6 which respectively engage the ring 7 in accordance with the position of the tray 2. The lever 5 is locked in engagement with the ring 7 by a wedge peg 8.

Further details of the sifting machine shown in the drawings, and its use in relation to the sifting of drilling mud used in oil drilling, will now be given briefly, mainly with reference to FIGS. 1 and 2.

The machine consists generally of the framework 4, on which there is supported by springs 11 a so-called sifting basket 12. The basket 12 is coupled to a vibratory drive unit 14 which is energised by operation of an actuator unit, not shown. The drive unit 14 vibrates the basket 12 preferably with a generally elliptical oscillatory motion having substantially horizontal and vertical components of which the horizontal component is of the lesser magnitude.

The basket 12 has opposed side walls 12A and an end wall 12B, and is open at the other end. The basket is also open at the top and bottom, and the base of the basket is formed by the screen S. As shown in FIG. 4, the screen is formed by two screen elements S1 which are located side-by-side and are removably clamped in position. The basket 12, at its bottom end, is reinforced by spaced cross bars 12C or by an open frame, which, in either case, may be formed integrally with the side walls and end wall.

In use, contaminated mud from a bore hole is fed under pressure of around 40 p.s.i. and at a flow rate of 400 to 1600 gallons per minute into two inlet ducts 20 of the machine. The ducts are each closed at one end and mud forced into the ducts 20 exits therefrom via side pipes 22 into several desilter cones or cyclone separators 23. Sixteen such cones are included in the illustrated machine, though only four can be seen. The pressurized mud enters the cones 23 generally tangentially via the pipes 22 so that a swirling action is generated within the cones. Owing to centrifugal force, the denser constituents of the contaminated mud, including barite, silt and cuttings, tend to segregate towards the bottoms of the cones 23, while the lighter constituents tend to flow upwardly towards the tops of the cones. The lighter constituents comprise principally the fluid. Fluid rising to the tops of the cones 23 enters discharge pipes 24 and flows from the machine via discharge ducts 25. The fluid leaving ducts 25 is essentially free of silt and cuttings and can be re-formed into mud for recycling to a bore hole being drilled. Approximately 80% of the fluid content of the contaminated mud is separated by the desilter cones 23, from the barite, silt and cuttings, for re-use.

The remainder of the mud, comprising about 20% of the originally-present fluid, barite, silt and cuttings is discharged from the bottoms of the cones on to the chute 1. The chute 1 serves to deliver the mud to the upstream end of the basket 12. With the basket vibrating or shaking, fluid and barite in the mud are encouraged to pass through the screens to fall into a collector 30 whence they are removed through an outlet or outlets 31 for reconstitution into drilling mud. Silt and cuttings stay behind on the screen and, due to the vibratory motion, are gradually conveyed to a downstream end of the basket. Upon reaching downstream end, the silt and cuttings move on to a discharge lip or chute not shown and fall into a receptacle, not shown. The material accumulating in the receptacle is periodically discarded.

From time-to-time it is required that mud fed to the chute 1 should not be discharged on to the screens, so that the latter have to be by-passed. At present, this involves the use of ancillary equipment, such as a non-porous metal sheet which is placed on top of the screens, and this involves considerable time and labour. Because the present chute 1 is pivotable, the screens can be by-passed quickly and easily by inclining the chute in the direction opposite to that shown.

The vibratory drive unit 14 consists basically of a driven rotatable shaft 15 which extends transversely of the basket 12, and which has end portions projecting through the side walls 12A and carrying eccentric weights 16. The shaft 15 is housed within a casing 17 secured at its ends to the side walls 12A. The shaft 15 is spaced above the screens S1, and below the chute 1, and preferably passes through substantially the centre of gravity of the basket.

The shaft 15 is driven by a hydraulic motor 18 which is co-axial therewith, and is directly coupled to one end thereof. The motor 18 is carried by a casing 19 which is secured to the adjacent wall 12A of the basket, so that the motor is free to vibrate with the basket.

The motor 18 is driven by a power unit, not shown, comprising a pumping system driven by an electric motor, and speed control means, the hydraulic motor 18 being connected to the pumping system by flexible hoses. The speed of the motor 50 may be steplessly adjusted from 0 to 3000 r.p.m. by adjustment of the speed control means, and satisfactory operation can be obtained at 800 to 2000 r.p.m., the speed being varied by the operator, when necessary, to compensate for variations in the consistency, density, viscosity or gel strength of the mud.

The motor 18 may alternatively be a pneumatic motor or an electric motor.

The manner in which the screen sections S1 are located by clamping means will now be described, with special reference to FIG. 6.

Each screen section S1 consists of a rectangular frame on which a screen is tensioned. Each frame has opposed side members 35 of angle-section, of which the horizontal flange 35A projects outwardly from the vertical flange 35B. In FIG. 6, the end frame members are not shown, for clarity.

As both screens S1 are located in the same manner, reference will now be made only to the right-hand screen in FIG. 6.

The flange 35A of the outer frame member 35 rests on a ledge 36 on the adjacent side wall 12A of the basket 12. A bar 37 extends across the basket and projects through an aperture 38 in the wall 12A. The projecting end portion of the bar 37 is secured to a bracket 39, FIGS. 3, 4, 5, on the outer face of the wall 12A by a bolt 40 and a nut 41, and a compression spring 42 is located between the bar 37 and the bracket 39. A clamping strip 43 lies on top of the flange 35A and extends substantially throughout its length. The strip 43 is forced into pressing engagement with the ledge 36 by a spring-loaded plunger 44 carried by the bar 37. The plunger 44 consists of a pin having a head 44A, a foot 44B, and a compression spring 44C extending between the bar and the foot 44B. A bolt 45 is secured at its lower end in the clamping strip 43 and passes slidably through a bracket 46 secured to the inner face of the wall 12A, and a compression spring 47 extends between the head 45A of the bolt and the bracket 46.

At the other side, the left-hand side, of the same screen, the flange 35A rests on an inverted channel-section member 48 located in the basket 12 midway between the side walls 12A, and extending parallel thereto. The flange 35A is clamped in position by a clamping strip in the form of a rectangular-section tube 49, which is urged downwards by a block 50 secured to the bottom face of the bar 37.

Spaced longitudinally from the bar 37, a bolt 51 passes freely through the tube 49 and through the member 48. At its lower end, the bolt 51 is screwed into a nut 52 secured to the member 48. The bolt 51 has a head 51A spaced above the upper face of the tube 49, and a compression spring 53 extends between the upper face of the tube 49 and the upper face of the member 48, the spring 53 being compressed by the pressure of the bar 37. The flanges 35A of the inner and outer frame members 35 of the screen section at the left hand side are clamped in the same manner. The compression springs 42 may be omitted.

As shown best in FIGS. 4 and 5, there are three such clamping arrangements spaced longitudinally of the basket. Dependent upon the dimenions of any given basket, there may be only one or two or more than three such clamping arrangements.

A similar arrangement may be used with a single screen having a reinforcing frame member extending from end-to-end midway between the outer side frame members. In this case, the reinforcing frame member is clamped in the same manner as the adjacent inner flanges 35A. If there is only a single, relatively narrow screen, this can be clamped only at its sides.

In order to unclamp the screen sections S1, either the bolts 40 or the nuts 41 are turned to unclamp the projecting end portions of the bars 37 from the brackets 39, so that the springs 42 push the bars upwards sufficiently to raise the feet 44B of the plungers 44 substantially clear of the clamping strips 43, and the blocks 50 clear of the clamping strip 49. This results in the springs 47 pushing the pins 45 upwards, and, thus, the clamping strips 43 substantially clear of the screens. Also, the springs 53 push the clamping strip 49 upwards substantially clear of the screens at the adjacent sides of the screens. The screens can thus be quickly and easily withdrawn horizontally through the open end of the basket, and can be replaced and clamped in the reverse manner. That is to say, once the screens have been inserted, only the nuts 41 and the bolts 40 need be tightened.

In a modification, not shown, the clamping strips 43 may be omitted, and, in this case, the feet 44B of the plungers 44 may be in the form of relatively short strips.

A modification of the brackets 46, the pins 45 and the springs 47 will now be described with reference to FIG. 7, corresponding parts being indicated by corresponding numerals with the addition of the suffix X.

A bolt 45X, which does not have a head, is screwed at its lower end into the clamping strip 43X and is locked therein by an adhesive. A sleeve 55 is screwed on to an upper portion of the bolt 45X, and, as shown, passes slideably through the hole in the base of the bracket 46 and, at its lower end abuts the clamping strip 43X. The sleeve 55 has a head 55A, and the compression spring 47X extends between the head 55A and the base of the bracket. A lock nut 56 on the upper end of the bolt 45X locks the sleeve in position. The degree of compression of the spring 47X can be adjusted, if necessary by appropriate adjustment of the sleeve and the lock nut.

A modification of the member 48, the clamping strip 49, the pin 51, the nut 52 and the spring 53 will now be described with reference to FIG. 8, corresponding parts being indicated by corresponding numerals with the addition of the suffix X.

The modification resides in the fact that the member 48X is a rectangular-section tube, and a block 58 is secured to bottom face of the tube 48X, a lower end portion of the pin 51X passing through a hole 58A in the block, and receiving the nut 52X. The pin 51X may be screwed into the block 58.

From the above, it will be seen that the sifting machine above described provides considerable advantages over machines hitherto used in sifting drilling mud used in oil drilling. Thus, the screen or screens can be quickly and easily fitted and replaced by virtue of the simple clamping arrangement, the screen or screens can be easily and quickly by-passed by virtue of the pivotable chute, and the speed of vibration of the screen or screens can be quickly and easily varied to compensate for variations in the properties of the mud. As a result, sifting operations can be carried out more quickly and easily than hitherto.

We claim:

1. A sifting machine having a framework; a sifting basket resiliently mounted on said framework for vibratory movements, said sifting basket having opposed side walls, each with an inner face and an outer face, and a base formed by a screen tensioned on a rectangular screen frame; clamping means releasably securing said screen frame to said side walls; and a drive unit for effecting vibratory movement of said sifting basket; said clamping means comprising at least one bar spaced above said screen and extending across said basket and having opposed end portions projecting through apertures in said side walls respectively; a pair of brackets on the outer faces of said side walls; releasable fastening devices securing said end portions of the bar to said brackets; a pair of ledges respectively on opposed inner faces of said side walls; a pair of plungers carried by said bar and resiliently clamping opposed side members of said screen frame against said ledges respectively, and spring means located between said bar and each of said brackets for moving said bar upwards, when said fastening devices are released.

2. A sifting machine as claimed in claim 1, in which said side members of the frame are clamped between said ledges and clamping strips lying on top of said side members, said strips being clamped in position by said plungers, and in which each clamping strip is connected to a pin which is spring-urged upwardly relative to a further bracket provided on the adjacent side wall of the sifting basket, so that when the clamping pressure is released, said springs lift the clamping strips from said side members.

3. A sifting machine as claimed in claim 1 or 2, in which there are two side-by-side screen sections each with a rectangular frame, and adjacent side members of the frames are clamped between a lower support member in the basket, and an upper clamping strip, the latter being urged downwards, to effect clamping, by a block on the underside of said bar, and spring means is provided between the clamping strip and the support member to move the clamping strip upwards from the support member, when the clamping pressure is released.

4. A sifting machine as claimed in claim 1, in which there is a chute having its discharge end located above one end of the screen, said chute being pivotally mounted on said framework so that it can be pivoted between a position in which it discharges at one end on to the screen, and a position in which it discharges at its other end clear of the screen.

5. A sifting machine as claimed in claim 1, in which said drive unit for vibrating the basket comprises an eccentrically loaded shaft extending transversely of the basket, a hydraulic drive motor mounted on a side wall of the basket, co-axial with said shaft and in direct driving connection with the latter, and a power unit for driving said motor comprising a pumping system and speed control means by which the speed of the motor can be steplessly varied.

* * * * *